United States Patent [19]

Chen

[11] Patent Number: 4,900,398

[45] Date of Patent: Feb. 13, 1990

[54] CHEMICAL MILLING OF TITANIUM

[75] Inventor: Yu-Lin Chen, Indianapolis, Ind.

[73] Assignee: General Motors Corporation, Detroit, Mich.

[21] Appl. No.: 368,008

[22] Filed: Jun. 19, 1989

[51] Int. Cl.[4] ..... C23F 1/00; C23F 1/02; B44C 1/22; C03C 15/00

[52] U.S. Cl. ..... 156/664; 156/659.1; 156/656; 252/79.3

[58] Field of Search ..... 156/656, 659.1, 664; 252/79.2, 79.3; 134/3, 41

[56] References Cited

U.S. PATENT DOCUMENTS

| | | | |
|---|---|---|---|
| 2,827,402 | 3/1958 | Albers et al. | 134/28 |
| 2,847,371 | 8/1958 | Topelian | 204/33 |
| 2,856,275 | 10/1958 | Otto | 41/42 |
| 2,942,954 | 6/1960 | Thomas | 41/42 |
| 2,981,609 | 4/1961 | Acker et al. | 41/42 |
| 3,007,780 | 11/1961 | Beigay et al. | 156/20 |
| 3,082,137 | 3/1963 | LaBoda et al. | 156/18 |
| 3,514,407 | 5/1970 | Missel et al. | 252/79.3 |
| 3,666,580 | 5/1972 | Kreml et al. | 156/18 |
| 3,788,914 | 1/1974 | Gumbelevicius | 156/18 |
| 3,844,859 | 10/1974 | Roni | 156/18 |
| 3,944,496 | 3/1976 | Coggins et al. | 252/79.3 |
| 4,116,755 | 9/1978 | Coggins et al. | 156/659 |
| 4,220,706 | 9/1980 | Spak | 430/318 |
| 4,314,876 | 2/1982 | Kremer et al. | 156/664 |
| 4,345,969 | 8/1982 | James et al. | 156/659.1 |
| 4,416,739 | 11/1983 | Turner | 204/32 R |
| 4,540,465 | 9/1985 | Coggins et al. | 156/642 |
| 4,704,126 | 11/1987 | Baswell et al. | 623/10 |

OTHER PUBLICATIONS

"Hydrogen Absorption by Titanium and Titanium Alloys During Etching in Acid Solutions", V. N. Modestova et al., Institute of Physical Chemistry Academy of Sciences U.S.S.R., pp. 995–1004.

Machining of Titanium Alloys, pp. 505, 506.

*Primary Examiner*—William A. Powell

*Attorney, Agent, or Firm*—Lawrence B. Plant

[57] ABSTRACT

Process for chemically milling titanium using an aqueous milling solution consisting essentially of (by weight) about 1% to 5% HF, about 1.5% to 4% chlorate ion and optionally up to about 20% of an acid selected from the group consisting of $H_2SO_4$, HCl and $HNO_3$.

5 Claims, No Drawings

CHEMICAL MILLING OF TITANIUM

This invention relates to chemically milling titanium and alloys thereof.

BACKGROUND OF THE INVENTION

Due to their light weight, high strength and thermostability, titanium annd its alloys (hereinafter titanium) are useful metals for such aerospace applications as air frames and engine parts. Particularly effective alloys for such applications are the alpha and beta phase Ti-Al alloys as well as the high temperature Ti-Al intermetallics such as $Ti_3Al$ (alpha 2 phase), TiAl (gamma phase) and combinations thereof which are often mixed with the alpha and/or beta alloy phases. Engine parts are commonly machined to thin cross-sections and desirably have very smooth surface finishes. Chemical milling processes are often used for this purpose whereby desired shapes, dimensions and surfaces are achieved through selective or overall removal of large amounts of metal by controlled chemical dissolution. Areas of a part where metal removal is not desired may be protected from dissolution by masking with photoresist-type masks, or the like, so as to achieve selective removal of metal from some areas of the part and not others. In the chemical milling process, the part is typically immersed in a milling solution which is agitated or flowed across the part so as to continuously present a layer of relatively fresh solution to the surface being milled and achieve a uniform metal removal rate thereacross.

Popular milling solutions for titanium contain hydrofluoric acid in concentrations varying from about 1% to about 10% often in combination with one or more other acids, such as HCl, $HNO_3$ and $H_2SO_4$. Other ingredients such as phosphates, dichromates, chromates, permanganates inter alia may also be present. Many of the commonly used milling solutions tend to generate considerable hydrogen at the titanium surface which results not only in relatively slow metal removal rates and rough surface finishes, but also results in an untoward absorption of hydrogen by the titanium and consequent hydrogen embrittlement of the part. Such hydrogen embrittlement seriously weakens titanium and is unacceptable in thin-section engine parts which need all the strength the metal can provide. Moreover, many of the more commonly used chemical milling solutions chemically attack photoresist the masks commonly used to protect selected regions of the part from dissolution. Accordingly the usefulness of such milling solutions for selective milling is severely limited.

It is an object of the present invention to provide a process for chemically milling titanium utilizing a milling solution which: (1) substantially eliminates hydrogen evolution at the metal surface; (2) has a relatively high metal removal rate; (3) produces smooth bright finishes; and (4) is compatible with photoresist-type masks commonly used in the selective chemical milling of titanium. This and other objects and advantages of the present invention will be more readily apparent from the detailed description thereof which follows.

BRIEF DESCRIPTION OF THE INVENTION

The present invention comprehends a chemical milling solution for titanium comprising about 1% to about 5 % by weight HF, about 1.5% to about 4% by weight chlorate ion (e.g., ca. 20–50 g/l $NaClO_3$) and optionally up to about 20% by weight of a strong acid such as sulfuric acid (preferred), HCl or $HNO_3$. The chlorate ion may be supplied by chloric acid, but is preferably supplied by soluble chlorate salts such as sodium or potassium chlorate. The hydrofluoric acid is the primary metal dissolver whereas the chlorate prevents the generation of hydrogen at the metal surface by a mechanism believed to involve the formation of a thin oxide film on the surface which controls the dissolution reaction and results in excellent surface flatness and reduced hydrogen absorption. When the $ClO_3^-$ concentration falls below about 1.5%, hydrogen formation increases undesirably. When the $ClO_3^-$ concentration exceeds about 4% the metal removal rate is reduced significantly. Likewise, HF concentrations below about 1% result in a low metal removal rare and the formation of a violet scum on the surface while concentrations above about 5% result in too much hydrogen evolution. The other acid(s), when used, keep the acidity of the solution in the negative pH range where the milling solution is most effective. $H_2SO_4$ is the preferred such acid as it also results in a smoother finish than obtainable in the absence thereof. The solution of the present invention may effectively be used at temperature ranging from room temperature up to about 200° F., but will preferably be used at temperatures between about 100° F. and 125° F. (most preferred). At lower temperatures, the metal removal rate is unnecessarily slow while at higher temperatures milling control becomes more difficult. When using solutions in accordance with the present invention, acceptable metal removal rates (i.e., ca. 0.005–0.006 inches/hr.) and surface finishes with no visible hydrogen gassing occurring. A preferred solution in accordance with the present invention comprises by weight 2% hydrofluoric acid, 4% sulfuric acid, 3.5% sodium chlorate, and the balance water and is operated at 125° F. Such solutions have proven to be useful to mill pure titanium, pure aluminum and such alloys thereof as (1) 6 w/o Al, 4 w/o W, bal Ti; (2) 6 w/o AL, 2.75 w/o SN, 4 w/o Zr, 0.4 w/o MO, 0.45 w/o Si, 0.07 w/o O, 0.003 w/o Fe, bal Ti; (3) 24 a/o AL, 11 a/o Nb, bal Ti; (4) 46 a/o Al, 5 a/o Nb, 1 a/o W, bal Ti; and (5) 48 a/o AL, 1 a/o V, bal Ti; where "a/o" stands for the atomic percent and "w/o" the weight percent of the several alloyants. Finally, solutions of the present invention have been effectively used with ethylene glycol monomethyl ether-based photoresist films, such as Kodak KTFR, used to mask some areas of the metal while leaving other areas exposed to the milling solution for fabricating fine patterns. Operating temperatures around 100° F. are desirable when using the photoresist masks.

EXAMPLES

Example 1

Thin sheets (i.e., 6.5"×15.5"×0.008") of alpha two titanium alloy (i.e., 24 a/o AL-11 a/o Nb) were uniformly milled from both sides from an initial thickness of 0.008" down to 0.004" thick in 20 minutes without producing any pinholes utilizing solutions containing 20 milliliter/liter of 98% $H_2SO_4$ (3.6% by weight), 25 milliliters/liter of 50% HF (1.9% by weight) and 35 grams/liter of $NaClO_3$ and the balance water. The 0.004" sheets thus produced had a surface which was twice as smooth as that of the pre-milled surface and its apparent dutility was as good as the pre-milled sheets indicating little, if any, hydrogen embrittlement resulting from the milling treatment. Similar results were obtained using Ti6Al4V alloy sheets similarly dimensioned.

Example 2

Several rings (i.e., 13½"ID×17"OD×0.32" thick) comprising a titanium alloy containg 6 w/o aluminum and 4 w/o vanadium were rotated in a 30 liter bath of the solution of Example 1 to uniformly remove from 0.030" to 0.050" from every side thereof over milling periods varying from 10 to 20 hours. The finished rings displayed excellent flatness and smoothness indicative of very low residual stress and hydrogen absorption. Similar results have been obtained on panels of the same material.

Example 3

Several panels (7"×18") comprising a Ti-1100 titanium alloy containing 6 w/o AL, 2.75 w/o Sn, 4 w/o Zn, 0.4 w/o MO, 0.45 w/o Si, 0.47 w/o O and 0.003 w/o Fe were uniformly milled from both sides in the solution of Example 1. Initial thicknesses ranged from 0.008 inches to 0.012 inches which was uniformly down to about 0.004 inches to 0.005 inches in 20 to 40 minutes with a resulting smooth finish and no evidence of significant hydrogen embrittlement.

Example 4

Several panels (2"×5") comprising gamma titanium alloys containing 48 a/o Al-1 a/o V and 46 a/o Al-5 a/o Nb-1 a/o W were milled in the same manner as set forth in Example 1. The thickness was uniformly reduced at a rate about 0.004" per hour from each side. The finished surfaces were smooth and had no evidence of significant hydrogen embrittlement.

The metal removal rate is primarily a function of the fluoride ions and the metal removal rate generally declines with solution usage. Accordingly, to maintain acceptably high rates the solution is preferably periodically or continuously revitalized by the adding more HF to the solution. A fresh preferred solution milling at 125° F. generally removes metal from the surface at a rate of approximately 0.006"/hour. Agitation or flow of the solution over the surface to be milled is required to achieve uniform dissolution across the entire surface of the part.

Generally speaking, titanium alloy foil samples which had an absorbed hydrogen content of about 100–200 ppm, before milling, had an absorbed hydrogen content of only about 560–680 ppm after milling. Heat treating for one hour at 1300° F. under a high vacuum (e.g., $10^{-6}$ Torr) readily reduced the hydrogen content of such samples to only about 14 ppm. Higher preheat treatment hydrogen concentrations in the part, following milling, could result in the formation of metal hydrides therein which can not readily be removed by heat treating.

While the invention has been disclosed primarily in terms of specific embodiments thereof it is not intended to be limited thereto but rather only to the extent set forth hereafter in the claims which follows.

The embodiments of the invention in which an exclusive property or privilege is claimed are defined as follows:

1. In the method of chemically milling titanium comprising the principle steps of contacting a surface of said titanium to be milled with aqueous milling solution for a time sufficient to corrode said surface a predetermined amount, the improvement wherein said solution, by weight, consists essentially of 1% to about 5% hydrofluoric acid, about 1.5% to about 4% chlorate ion, and, optionally, up to about 20% of an acid selected from the group consisting of $H_2SO_4$, HCl, and $HNO_3$.

2. The method according to claim 1 wherein said acid is $H_2SO_4$ and said chlorate ion is provided by a salt selected from the group consisting of sodium and potassium chlorate.

3. The method according to claim 2 wherein said solution consists essentially of about 2% hydrofluoric acid, about 4% sulfuric acid, and about 3.5% sodium chlorate.

4. The method according to claim 3 wherein said milling is performed at temperatures up to about 200° F.

5. The method according to claim 4 wherein said milling is performed at temperatures between about 100° F. and 125° F.

* * * * *